US005395485A

United States Patent [19]

Nashan et al.

[11] Patent Number: 5,395,485

[45] Date of Patent: Mar. 7, 1995

[54] REACTOR CHAMBER DOOR FOR LARGE-SCALE COKING REACTORS

[75] Inventors: Gerd Nashan, Oberhausen; Klaus Wessiepe, Essen; Heribert Bertling, Hattingen; Werner Abendroth, Haltern; Helmut Dohle, Bochum; Manfred Friedrichs, Essen; Gerd Klinkenberg, Mühlheim/Ruhr; Manfred Blase, Essen; Heinz Dürselen, Essen; Günter Meyer, Essen; Wolfgang Rohde, Essen, all of Germany

[73] Assignee: Bergwerksverband GmbH, Essen, Germany

[21] Appl. No.: 956,774

[22] PCT Filed: Apr. 18, 1991

[86] PCT No.: PCT/EP91/00739

§ 371 Date: Dec. 17, 1992

§ 102(e) Date: Dec. 17, 1992

[87] PCT Pub. No.: WO91/16404

PCT Pub. Date: Oct. 31, 1991

[30] Foreign Application Priority Data

Apr. 20, 1990 [DE] Germany ..... 4012572.6
Feb. 6, 1991 [DE] Germany ..... 4103504.6

[51] Int. Cl.[6] ..... C10B 25/06; C10B 25/16

[52] U.S. Cl. ..... 202/248; 202/269

[58] Field of Search ..... 202/248, 269; 110/173 R

[56] References Cited

U.S. PATENT DOCUMENTS 2,200,403 5/1940 van Ackeren ..... 202/248
4,067,778 1/1978 van Ackeren et al. ..... 202/248

FOREIGN PATENT DOCUMENTS 0154232 4/1988 European Pat. Off. .
1102059 6/1949 France .
1102911 7/1951 France .
2532097 8/1978 Germany .
591200 8/1947 United Kingdom .

*Primary Examiner*—Joye L. Woodard
*Attorney, Agent, or Firm*—Herbert Dubno; Yuri Kateshov

[57] ABSTRACT

A large-scale coking reactor including a housing provided with a chamber and with outer and inner chamber frames, a displaceable outer door elastically compressed against the outer frame and formed with a respective elastic peripheral seal compressible against the frame and with an outer high temperature membrane interposed between the door and the seal and elastically pressed thereagainst to seal the door opening, a displaceable inner door spaced from the outer door and formed with an inner high temperature membrane interposed between the inner door and the inner frame to fit elastically the inner frame, the inner and outer doors being releasably interconnected upon displacing the outer door, so that the doors are mounted in the housing to be operatable either selectively or in combination with one another.

12 Claims, 4 Drawing Sheets

REACTOR CHAMBER DOOR FOR LARGE-SCALE COKING REACTORS

CROSS REFERENCE TO RELATED APPLICATIONS

This application is a national phase application corresponding to PCT/EP91/00739 filed Apr. 18, 1991 and based, in turn, upon German applications P40 12 572. 6 and P41 03 504. 6 filed respectively Apr. 20, 1990 and Feb. 6, 1991 under the International Convention.

1. Field of the Invention

The invention relates to a reactor chamber door for large-scale coking reactors with a double sealing system.

2 Background of the Invention

From DE 25 32 097 C3 an oven chamber closure for a coking oven with horizontal chambers, which has a double sealing system, is known. Thereby the two seals fastened to the rigid door body together with the metallic walling of the door body, the door frame and the wall protection plates, as well as with further adjacent metallic walling frames, form the so-called pre-chamber. This closure pertains to a very complicated coke oven door with rigid door body made of a casting and a heavy brick lining connected thereto. A compensation of the door-frame deformations caused by temperature is possible only to a limited extent in this known door structure and the pertaining sealing systems.

OBJECT OF THE INVENTION

It is the object of the invention to propose a reactor chamber door for large-scale coking reactors with extra large chamber volume, wherein the drawbacks of known chambers do not occur.

SUMMARY OF THE INVENTION

In order to solve this problem, the invention proposes a reactor chamber door consisting of an outer door and an inner door, which are releasably interconnected and optionally can be handled separately, each of them having its peripheral door sealing system, elastically compressible against the chamber frame.

In this reactor chamber door the outer door and the inner door are loosely interconnected, so that one of the two doors can be replaced in a simple manner for maintenance and repair. Besides, the outer door and the inner door each have their own door sealing system with their own elastic compressibility against the chamber frame. The outer and the inner door can be connected to each other by interengaging support claws and girders in such a manner that the support claws arranged on the inside of the outer door engage underneath the girders provided on the outside of the inner door. This construction can be compared to the door removal devices in conventional coke ovens. It has the advantage that the outer and the inner door can be commonly inserted into, respectively removed from the door openings of the reactor chamber.

Contrary to the multipart coke oven door described in the EP 0 154 232 B1, wherein the inner part is held in dogs of the oven frame and the oven frame has to withstand the pressure exerted by the content of the oven chambers, according to the invention the inner door is not suspended from the chamber frame and the pressure forces exerted by the content of the reactor chamber on the door lining are transmitted to the support frame of the outer door via lining holders, door contact areas between the inner and the outer door, optionally spacers and/or adjusting screws.

According to the invention, the inner door consists of a high temperature membrane covering the entire door opening and which is peripherally compressible against the chamber frame. This is a metal on metal seal arranged in the hot zone. Due to the high temperatures in this zone there are no deposits of tar condensate, so that this seal is maintenance free to a large extent. In order to compensate the deformations between the door frame and the high temperature membrane, leaf springs are adjustably fastened to the support construction for the lining holders, which press the high temperature membrane from the outside against the chamber frame.

The door sealing system at the outer door consists of a membrane covering the entire door opening with a peripheral seal, elastically compressible against the chamber frame, preferably a soft seal designed like a solid profile or a tube. It has been proven that in the double sealing system of the invention, these outer soft seals are not contaminated with tar deposits and also remain sufficiently elastic.

In order to prevent heat loss, an insulation can be provided /n the inside of the outer-door membrane. In this insulation, spacers are suitably provided for the transmission of the forces exerted by the content of the reactor chamber on the adjusting screws fastened to the support frame. According to the invention, similarly to the inner door, the seals on the outer door can be pressed against the chamber frame by means of leaf springs adjustably fastened to the support frame of the outer door, individually or in groups, preferably in the longitudinal direction of the reactor chamber.

For the compensation of deformations between chamber frame and the reactor chamber door it is further provided that at the outer door the distance between the support structure and the membrane can be changed with the aid of adjusting screws.

According to the invention, the clearance between the outer membrane respectively the insulation fastened to the membrane and the inner high temperature membrane, as well as the chamber frame can be filled with a barrier gas, particularly inert gas and kept under overpressure to avoid the escape of raw gas.

It has also proven to be advantageous to build the chamber frame by joining two separate frames, optionally with an interposed insulating layer. Thereby the sealing system of the inner door can come to lie against the inner chamber frame and the sealing system of the outer door against the outer chamber frame.

For further improvement of the sealing system it is advantageous to provide a peripheral, exchangeable sealing cord in the U-shaped chamber frame of the door lining, resting against the walls of the reactor chamber.

It is further suitable to provide the door lining with a trapezoidal frame whose lateral walls form cones which fit the conically shaped chamber walls in the input area of the reactor chamber.

Finally, it can be advisable to perform the guidance of the reactor chamber door alternately via guide elements rigidly connected to the support frame and have a bore at the free end wherein several guide pins which in turn are fastened to the wall protection plates can engage for forced guidance.

BRIEF DESCRIPTION OF THE DRAWING

The above and other objects, features and advantages will become more readily apparent from the following description, references being made to the following accompanying drawing in which.

SPECIFIC DESCRIPTION

Figure 1:
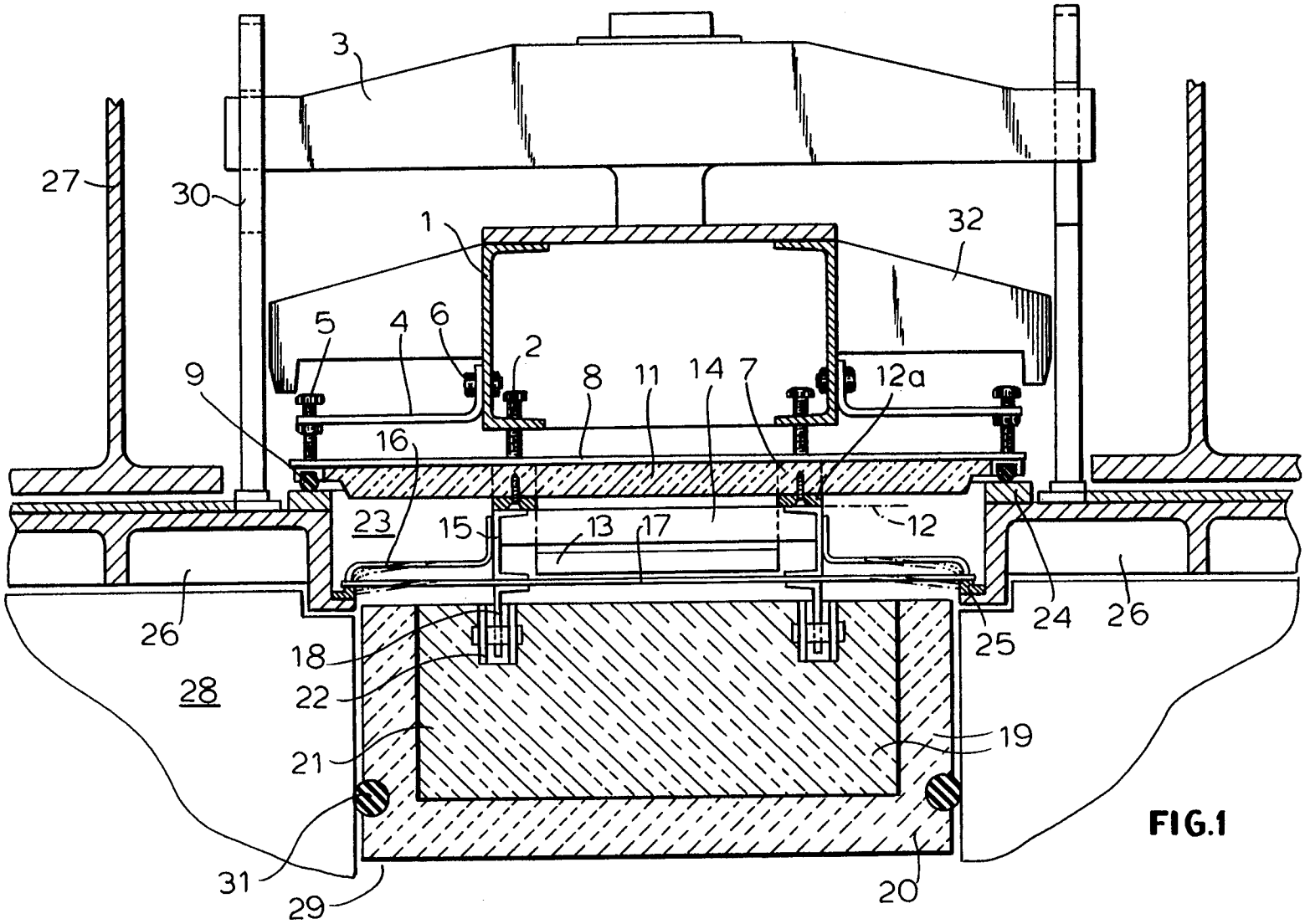
FIG. 1 is a cross-sectional view of one of the embodiments of the door assembly according to the invention.

The reactor chamber door consists of a support frame 1 extending over the entire door height with two or more locks 3 designed as beams or springs, which engage in latches 30. The support frame 1 consists of two vertical U-shaped profiles. On the outside of these U-shaped profiles, door guides 32 are fastened, these guides sliding along the inside of latches 30 when the door is inserted. Besides the so-called outer door consists also of the outer membrane 8, whose distance from the support frame 1 can be changed by means of adjusting screws 2 also while the operation is running. In a U-shaped mounting at the circumference of the membrane, replaceable soft gaskets 9, 10 are provided, which are compressed against the sealing surface at the outer chamber frame 24 by means of leaf springs 4, 4*a*.

According to FIG. 1, the peripheral angular lateral leaf springs are fastened to the support frame 1 by screws 6. In order to compensate irregularities, the distance between the end of the leaf springs 4 and the outer membrane 8 can be changed by means of screws 5.

Figure 2:
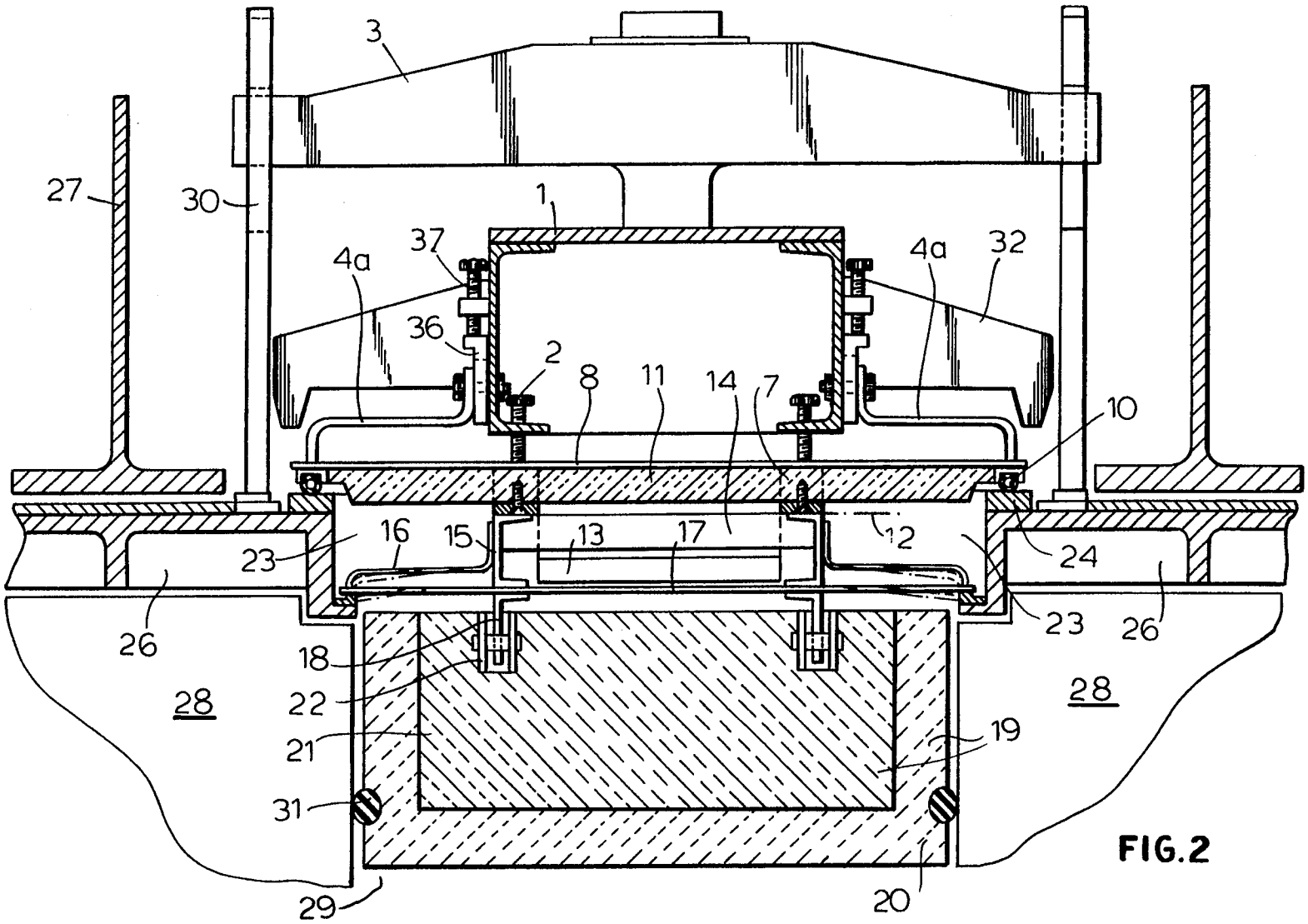
FIG. 2 is a cross-sectional view of another embodiment of the door assembly according to the invention.

According to FIG. 2, the leaf springs 4*a* are Z-shaped and are fastened to support frame 1 so that they can be displaced in the longitudinal direction of the chamber with the assistance of clamping plates 36 and adjusting screws 37 known per se.

In FIG. 1 the peripheral soft gasket is shown as solid profile 9 and in FIG. 2 as tube 10. Further to the outer door pertains the insulation 11 covering the inside of the outer membrane 8, with therein arranged spacers 12*a* and the door contact surfaces 12 facing the inner door. Further with the support frame 1 support claws 13 are connected, which for the transport of the inner door engage underneath the girders 14 of the latter. The inner door consists of the two vertical channel beams 15 with the horizontal support beam 14, the peripheral leaf springs 16 fastened to the channel beams 15, whose free ends press the rims of the high-temperature membrane 17 against the inner chamber frame 25. The lining holders 18 shaped like hooks are solidly bolted with the channel beams 15 and the high temperature membrane 17, these holders engage in the suspension pockets 22 of the door lining 19. The door lining consists of an outer U-shaped frame 20 of fireproof material or heat-resistant steel and the inner insulation 21. In order to seal the door lining 19 with respect to the vertical chamber walls and optionally with respect to the chamber bottom and the chamber ceiling as well, on the outside on frame 20 a circumferential replaceable sealing cord 31 is provided.

In the clearance 23 between the inner membrane 17 and the outer membrane 8, respectively the insulation 21 a barrier gas, particularly an inert gas, optionally under pressure, can be fed in order to avoid the escape of raw gas. The two chamber frames 24 and 25 form a unit with the wall protection plate 26 and together with anchor brackets 27 form the anchoring system for the reactor heating wall 28.

Both chamber frames are built as thin rectangular or angular profiles and are optionally kept in front of the wall protection plate 26, by interpositioning of insulation from the outside. They are optionally separately replaceable. Soft gaskets 9, 10 come to rest against the outer chamber frame 24 and the rim of the high temperature membrane comes to rest against the inner chamber frame 25.

Due to the construction, the temperature at the inner sealing between the chamber frame 25 and the membrane 17 will be so high that no tar condensation will take place and therefore the cleaning of the sealing zone will be eliminated. The pressure exerted by the furnace charge in the reactor chamber 29, particularly by hot coal charges, on the door lining 19 is transmitted directly to the support frame 1 via lining parts 20, 21, the suspension pockets 22, the lining holders 18, the channel beams 15 and the adjusting screws 2, and to the latches 30 via locks 3.

Figure 3:
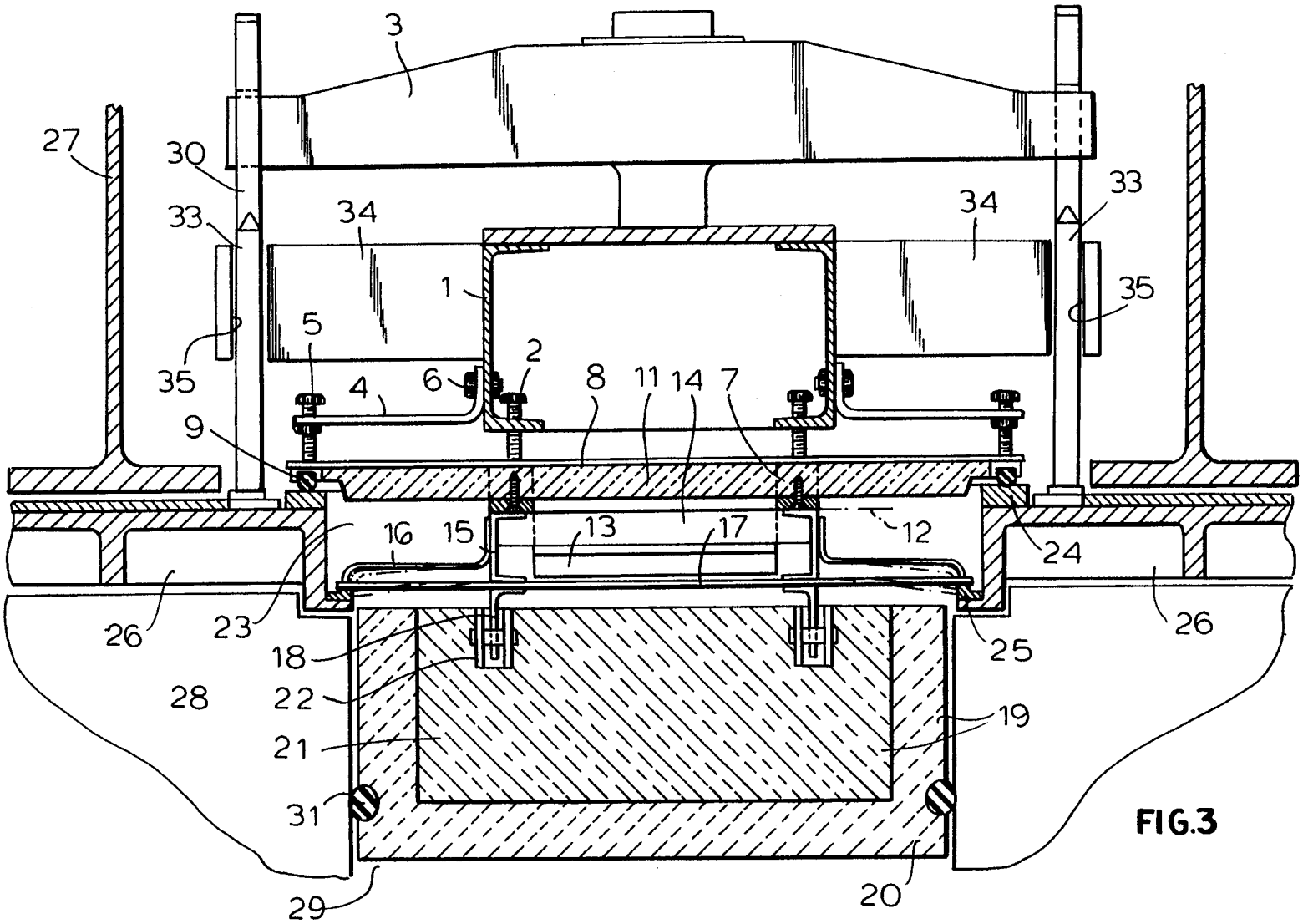
FIG. 3 is a cross-sectional view of still another embodiment /f the door assembly according to the invention.

According to FIG. 3, the guidance of the reactor chamber door is performed not by means of door guides 32 as in FIGS. 1 and 2, but by guidance elements 34, each having a cylindrical or optionally conical bore 35, wherein the slide the pilot bars 33 are fastened to the wall protection plate 26 slide, during the insertion of the reactor chamber door.

Figure 4:
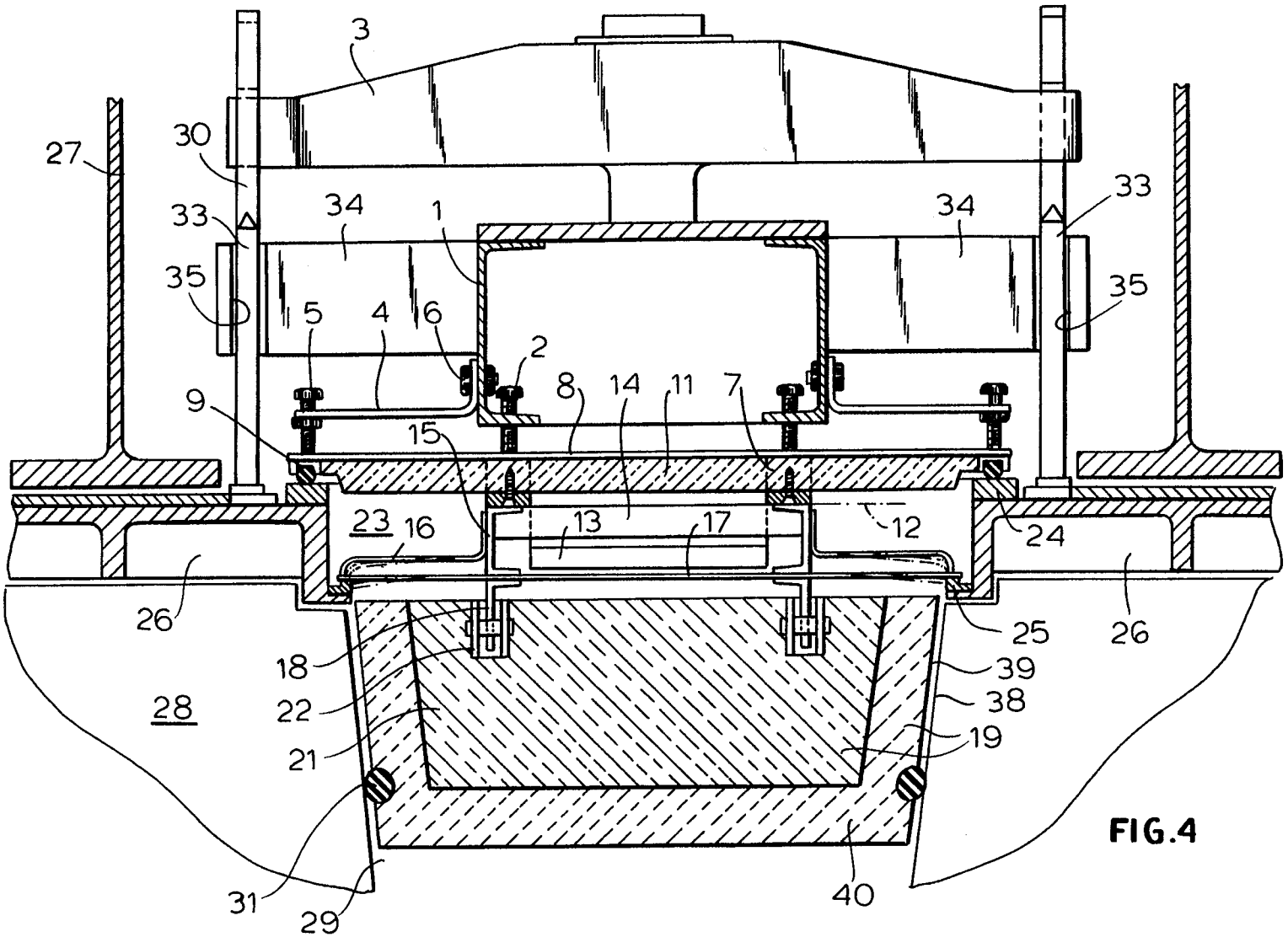
FIG. 4 is a cross-sectional view of yet further embodiment of the door assembly according to the invention.

According to FIG. 4, the reactor chamber has in its access area a conically shaped chamber wall 38. In this example the door lining 19 is correspondingly equipped with a trapezoidal frame 40, whose lateral walls 39 form cones. This configuration facilitates the insertion and the withdrawal of the reactor chamber door.

We claim:

1. A large-scale coking reactor, comprising:

a coke oven housing provided with a coking chamber, an opening communicating with said chamber, and with outer and inner chamber frames around said opening;

an outer door formed with a respective periphery and displaceable between closed position corresponding to covering a door opening in said housing and an open position, said outer door being provided with:

an outer elastic peripheral seal compressible against said outer frame and juxtaposed with said periphery, and an outer high temperature membrane covering the entire opening and being operatively connected with said outer seal, said outer seal being pressed against said outer frame to seal said opening;

an inner door spaced inwardly from said outer door and displaceable between a respective closed position corresponding to covering the opening and a respective open position, said inner door being formed with a respective periphery and being provided with:

an inner high temperature membrane covering the entire opening and bearing peripherally upon said inner frame, and inner resilient means provided on said periphery of said inner door and connected with said inner membrane for compensating the deformation between the inner frame and said inner high temperature membrane upon changing of the temperature, said inner membrane being elastically fit to said inner frame in the closed position of said inner door, and connecting means for releasably interconnecting said inner and outer doors for joint movement upon opening of said doors but permitting relative movement of said inner and outer doors in said closed position.

2. The reactor defined in claim 1 wherein said outer seal has a solid profile.

3. The reactor defined in claim 1 wherein said outer seal is a tube.

4. The reactor defined in claim 1 wherein said connecting means includes a plurality of support claws mounted on said outer door and a plurality of support girders mounted on said inner door and engaging said claws upon displacing said outer door to the respective open position.

5. The reactor defined in claim 1 wherein said outer membrane is formed with an insulating layer provided on an inner side of said outer membrane, said layer being provided with a plurality of spacers extending inwardly toward said inner door.

6. The reactor defined in claim 1 wherein said outer door is further provided with:

a support frame, a plurality of leaf springs mounted adjustably on said support frame and bearing on the periphery of said outer membrane, and a plurality of adjusting screws varying a distance between the support frame and said outer membrane.

7. The reactor defined in claim 1 wherein said inner and outer chamber frames form a clearance therebetween defined between said inner and outer membranes and filled with a barrier gas.

8. The reactor defined in claim 1, further comprising a door plug spaced axially inwardly from said inner door in said chamber and including an outwardly open plug frame receiving a door lining and an exchangeable sealing cord pressingly fitting between said chamber and said plug frame.

9. The reactor defined in claim 8 wherein said plug frame has a U-shaped cross-section.

10. The reactor defined in claim 8 wherein said door lining is provided with a plurality of lining holders extending outwardly and being in contact with said outer door and transversed by said inner membrane.

11. The reactor defined in claim 8 wherein said plug frame has a trapezoidal cross-section fitting in said chamber which is formed with lateral walls tapering axially inwardly.

12. The reactor defined in claim 1, further comprising:

a wall protection plate extending between said inner and outer chamber frames, a plurality of pins mounted on said protection plate and extending axially outwardly, and guide elements provided on said outer door and formed with respective means for engaging said pins.

* * * * *